US012502702B2

(12) United States Patent
Djuric et al.

(10) Patent No.: US 12,502,702 B2
(45) Date of Patent: Dec. 23, 2025

(54) PRESS BRAKE WITH ROTARY TOOL ASSEMBLY

(71) Applicant: Ariel Financing Ltd., Surrey (CA)

(72) Inventors: Dragisa Djuric, Surrey (CA); Steve Hilton, Surrey (CA)

(73) Assignee: Ariel Financing Ltd., Surrey (CA)

( * ) Notice: Subject to any disclaimer, the term of this patent is extended or adjusted under 35 U.S.C. 154(b) by 215 days.

(21) Appl. No.: 17/458,011

(22) Filed: Aug. 26, 2021

(65) Prior Publication Data

US 2023/0069244 A1 Mar. 2, 2023

(51) Int. Cl.
*B21D 5/02* (2006.01)
*B21D 5/00* (2006.01)

(52) U.S. Cl.
CPC ..... *B21D 5/0209* (2013.01); *B21D 5/002* (2013.01)

(58) Field of Classification Search
CPC .... B21D 5/0209; B21D 5/002; B21D 5/0236; B21D 5/0254; B21D 5/0281; B21D 37/04
USPC ..... 72/386, 477, 482.92
See application file for complete search history.

(56) References Cited

U.S. PATENT DOCUMENTS 1,664,851 A * 4/1928 Class ..... B23Q 16/06 74/824
2,426,446 A * 8/1947 Funk ..... B21D 5/0254 72/429
2,943,496 A * 7/1960 Valentine ..... F16H 25/186 251/258
7,168,286 B1 1/2007 Pelech
2015/0122060 A1* 5/2015 Cui ..... F16H 21/50 74/89

FOREIGN PATENT DOCUMENTS

| | | | |
|---|---|---|---|
| JP | 09-168826 | A | 6/1997 |
| JP | 11-151597 | A | 6/1999 |
| JP | 2001-018021 | A | 1/2001 |
| KR | 10-2226334 | B1 | 3/2021 |

OTHER PUBLICATIONS

International Search Report and Written Opinion dated Dec. 21, 2022 issued by the Korean Intellectual Property Office (ISA/KR) in related International Application No. PCT/US2022/041761; filed Aug. 26, 2022.

* cited by examiner

*Primary Examiner* — Adam J Eiseman
*Assistant Examiner* — Fred C Hammers
(74) *Attorney, Agent, or Firm* — Gordon Rees Scully & Mansukhani LLP

(57) ABSTRACT

A press brake machine configured to bend a workpiece. The machine includes an upper beam configured to hold an upper tool assembly that includes an upper rotary tool configured to hold an upper punch and an upper die. The machine also includes a lower beam configured to hold a lower tool assembly that includes a lower rotary tool configured to hold lower punch and a lower die. The upper rotary tool assembly is configured to rotate the upper punch and the upper die and the lower rotary tool assembly is configured to rotate the lower punch and the lower die. The upper rotary tool assembly is configured to position to the upper punch downwards to a first upper rotary tool position when the lower rotary tool assembly positions the lower die upwards to a first lower rotary tool position such that the upper punch.

18 Claims, 8 Drawing Sheets

PRESS BRAKE WITH ROTARY TOOL ASSEMBLY

The present disclosure relates to a press brake system. In particular, a rotary tool assembly for a press brake.

The process of forming sheet metal typically incorporates the use of a metal forming press brake consisting of two forming assemblies which are pressed against one another by the press brake. The press brake typically includes an upper ram assembly which includes a heavy metal ram, a punch holder that clamps and holds a punch that is driven down into a stable forming die mounted on a lower bed assembly. The bed assembly includes a clamping system to hold the lower die in place while metal forming is performed. The process creates a bend on the sheet metal that forms to the contour of the die. Since the punch and the die are affixed during the bending process, in order to make an opposite or reverse angled bend in the sheet metal, the press brake must be paused and the sheet metal workpiece must be turned over in order to allow the press brake to form the opposite or reverse bend. Pausing the press brake and moving the sheet metal workpiece is inefficient. Thus, there is a need for a press brake system that provides faster and more efficient forming process.

As described herein, an improved press brake punch and die system is provided in order to address the concerns discussed above.

BRIEF DESCRIPTION OF THE DRAWINGS

The features, aspects, and advantages of the disclosed press brake and tool system will become apparent from the following description, and the accompanying exemplary embodiments shown in the drawings, which are briefly described below.

DETAILED DESCRIPTION

The press brake machine described herein may be generally structured, for example, in the manner of the press brake machine disclosed in application Ser. No. 16/541,021, filed on Aug. 14, 2019 (incorporated by reference herein in its entirety). An exemplary press brake machine may include a ram located above a bed. The machine may include one or more hydraulic cylinders that force the ram (and a connected punch) downward toward the bed (and a connected die). Alternatively, the force of hydraulic pressure may be used to force the bed upward. The press brake machine processes a workpiece (e.g., sheet metal) by bending the workpiece to form a desired shape.

According to an embodiment disclosed herein, a press brake is configured to bend a workpiece includes an upper beam configured to hold an upper rotary tool. The upper rotary tool includes an upper punch and an upper die. The press brake includes a lower beam configured to hold a lower rotary tool, wherein the lower rotary tool includes a lower punch and a lower die. The upper rotary tool is configured to rotate between two positions wherein one or the other of the upper punch and the upper die is positioned to make contact with the workpiece. The lower rotary tool is configured to rotate between two positions wherein one or the other of the lower punch and the lower die is positioned to make contact with the workpiece. The upper rotary tool is configured to position the upper punch downwards when the lower rotary tool positions the lower die upwards so that the upper punch and the lower die are configured to bend the workpiece when one of the upper beam and lower beam is moved in a direction towards the workpiece.

Figure 1:
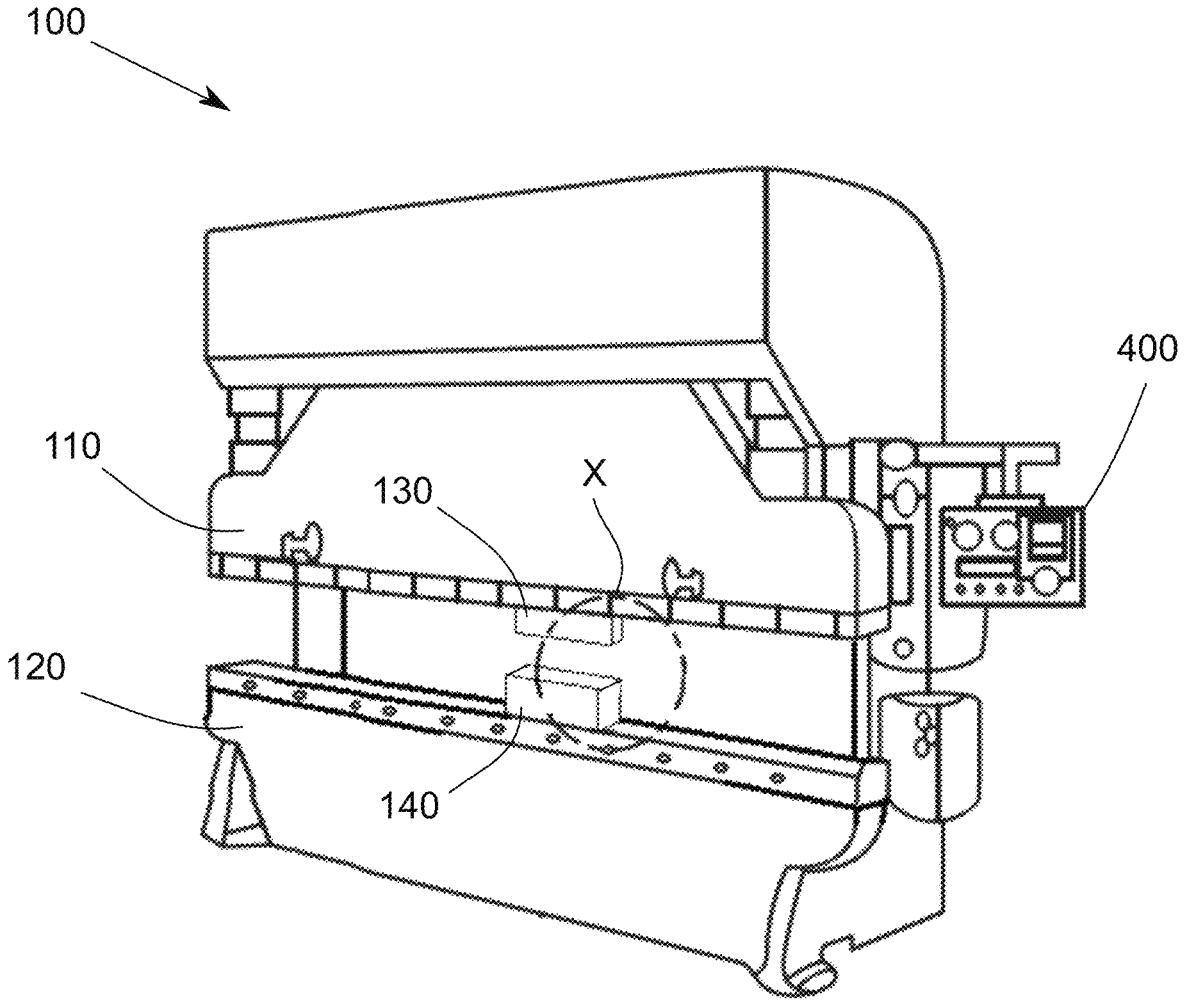
FIG. 1 is an isometric view of an exemplary press brake.

FIG. 1 shows an exemplary press brake machine 100. The press brake machine is used to bend or otherwise deform sheet-like workpieces, such as sheet metal workpieces (not shown). The press brake machine may include a controller 400 configured to operate the press brake either manually or autonomously. The controller 400 may also be used to control the movement of the workpiece and any tools associated with the press brake machine. Additional parts such as tooling systems, gauges, and measurements systems disclosed in U.S. patent application Ser. Nos. 15/814,158, 16/180,983, 16/541,060, 16/541,021, and 16/578,188 (all incorporated by reference herein in its entirety) may be utilized be the press brake machine 100. The press brake machine 100 has an upper beam or ram 110 and a lower beam or bed 120, at least one of which is movable toward and away from the other. Preferably, the upper beam is movable vertically while the lower beam is fixed in a stationary position. Although generally fixed, the position of the lower beam may be adjusted through use of a crowning system to ensure consistent bending of longer workpieces. The press brake machine 100 of FIG. 1 is used for exemplary purposes, and the rotary tools described herein can be employed with such a press brake machine or other conventional press brake machine.

Figure 2:
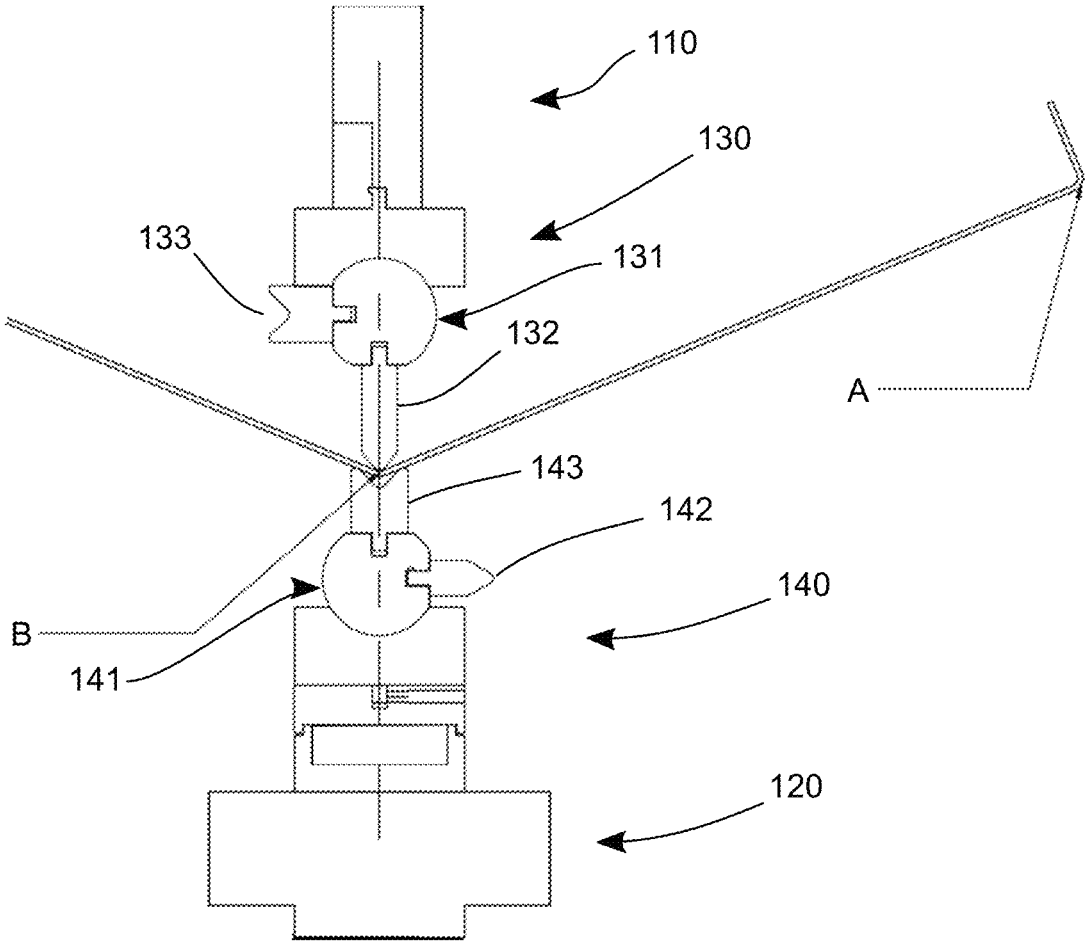
FIG. 2 is a side view of a press brake including a rotary tool assembly in a first position.

FIG. 2 is an isolated sectioned close up 'X', as labeled in FIG. 1, of the upper beam 110 with the upper tool assembly 130, lower tool assembly 140, lower beam 120, and a workpiece 200 with a first bend "A" and second bend "B". The upper tool assembly 130 includes an upper rotary tool 131 that holds an upper punch 132 and an upper die 133. Similarly, the lower tool assembly 140 includes a lower rotary tool 141 that holds a lower punch 142 and a lower die 143. In the configuration shown in FIG. 2, the upper punch 132 projects downward into the lower die 143 in order to create the second bend "B". Workpiece 200 is disposed above the lower die 143 and below the upper punch 132. The upper punch 132 includes a workpiece deforming surface at the tip. The configuration of the deforming surface is dictated by the shape into which it is desired to deform a workpiece 200. The shape of the workpiece is also dependent on the shape of the lower die 143, which can utilize different shapes. When the upper and lower beams 110/120 are brought together, the workpiece 200 located between them is pressed by the punch into the die to give the workpiece a desired deformation (e.g., a desired bend).

Figure 3:
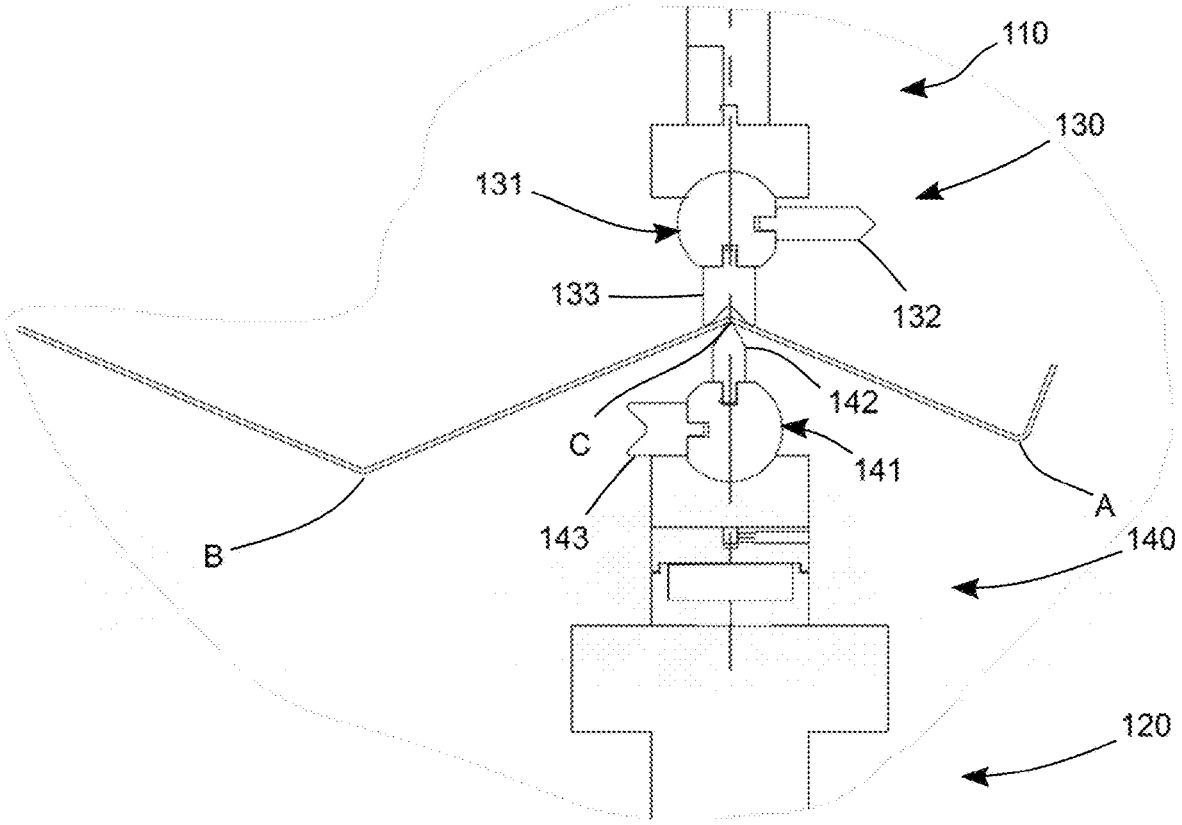
FIG. 3 is a side view of the press brake shown in FIG. 2 with the rotary tool assembly in a second position.

Both rotary tools 131 and 141 are configured to rotate in order to create different bends. For example, upper rotary tools 131 may rotate so that the upper die 133 is facing the workpiece 200 while the lower rotary tools 141 rotates so that the lower punch 143 is facing the workpiece 200. FIG. 3 shows the rotated positions of the rotary tools 131, 141. In FIG. 3, the press brake assembly is arranged so that the upper and lower rotary tools are positioned so that upper die 133 and lower punch 142 are in place to bend the workpiece with a downward bend "C". In the position shown in FIG. 3, the lower beam 120 may be configured to move upwards rather than having the upper beam 110 move downwards, or both the lower beam or upper beam may be configured to move in order to make the bend "C".

Figure 4:
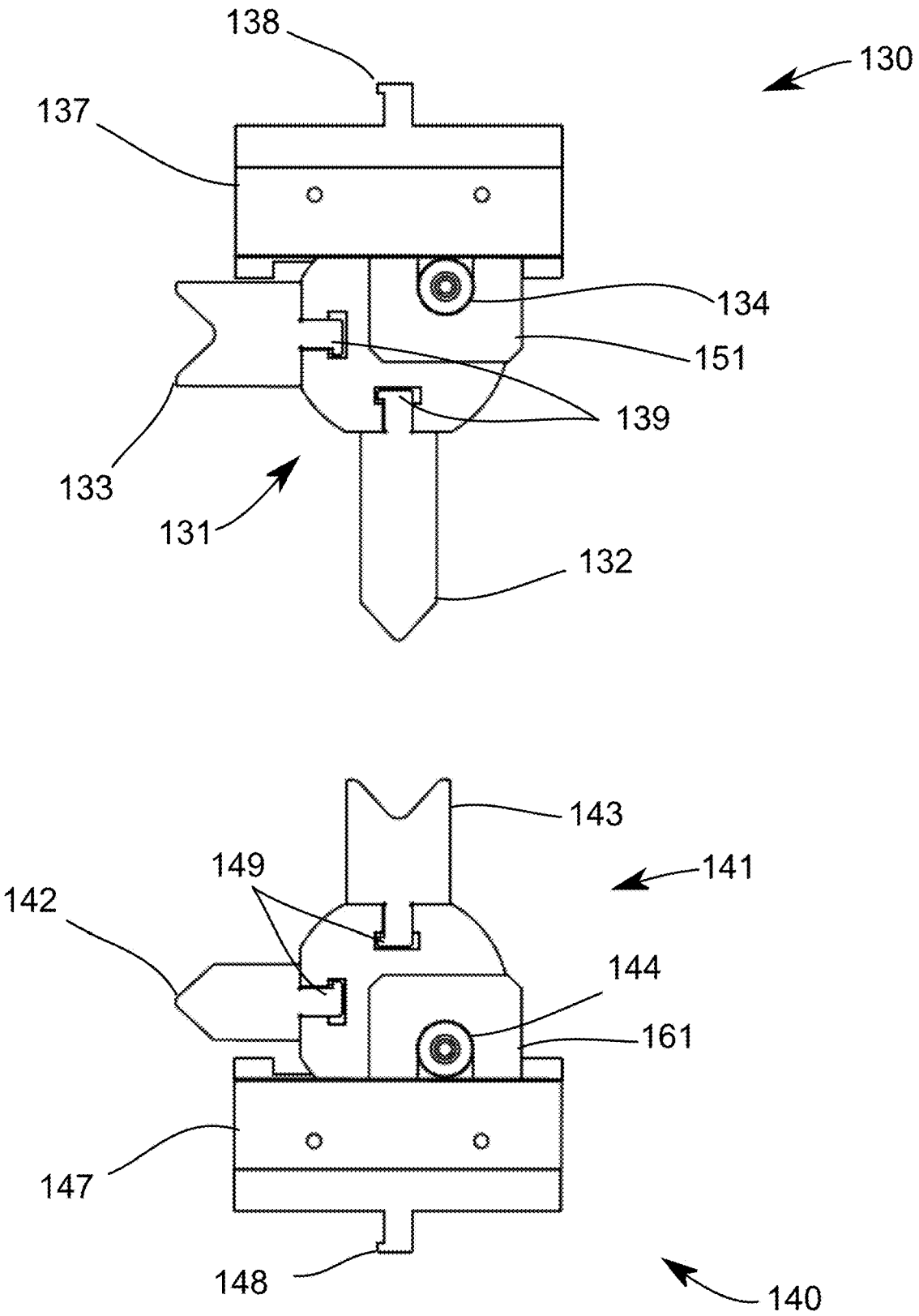
FIG. 4 is a close up view of the rotary tool assembly of FIG. 2 in the first position.
Figure 5:
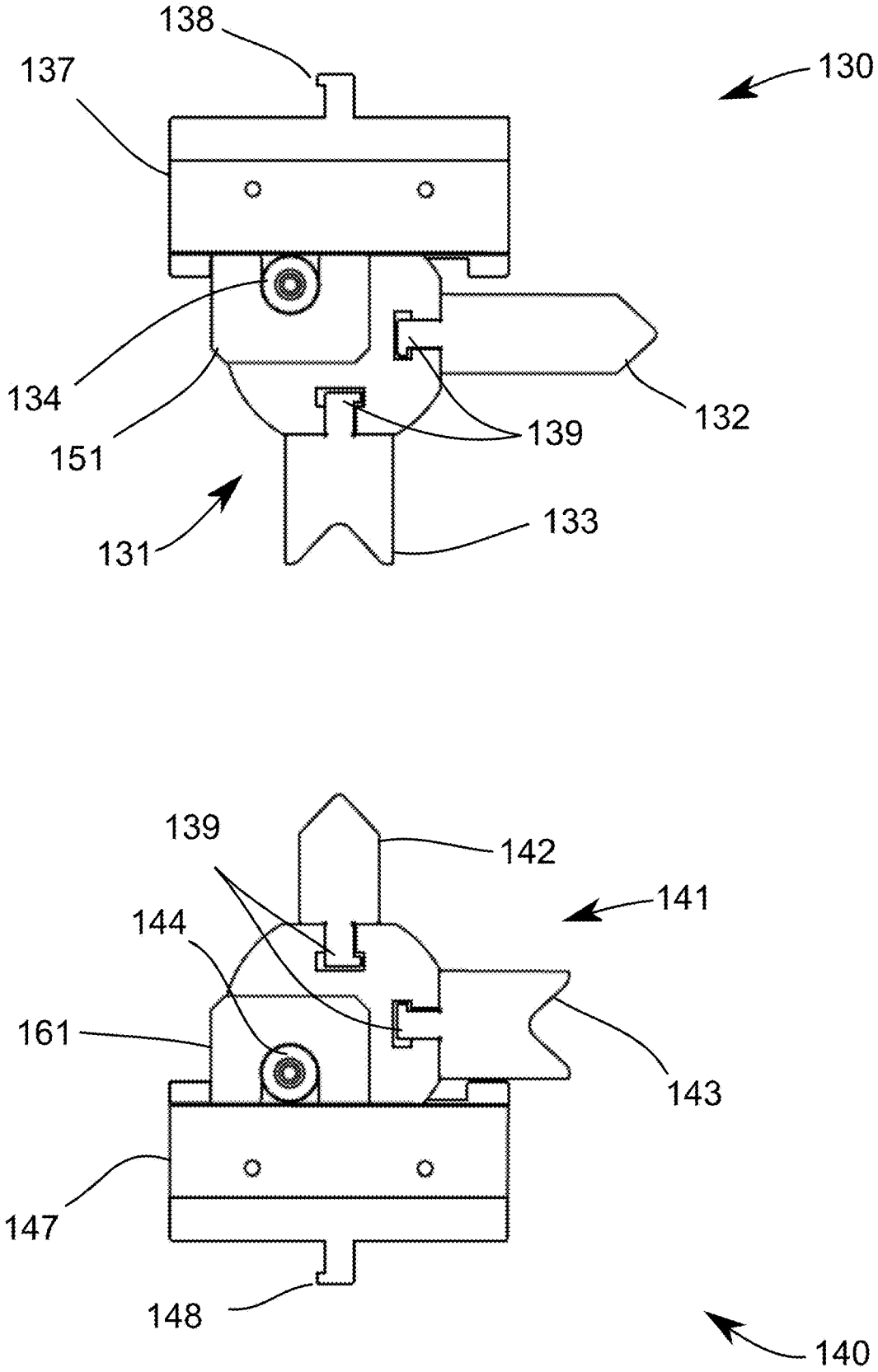
FIG. 5 is a close up view of the rotary tool assembly of FIG. 2 in the second position.

FIGS. 4 and 5 show a detailed side view of the rotary tools 131/141 as shown in FIG. 2 (first position) and FIG. 3 (second position) respectively. In addition to a punch and die, each rotary tools 131 and 141 further include a rotation pin 134/144 configured to be pushed or pulled in a straight linear motion via the rotational bracket 151/161 through an actuator 170 (see FIG. 8) between the first position and second position. The upper tool assembly 130 and lower tool assembly 140 includes a tool support 137/147 configured to attach to the upper beam 110 and lower beam 120 respectively. Each tool support 137/147 may include an attachment mechanism 138/148, which may be a hook configured to fit within the upper beam and lower beam respectively. The punch and die of the rotary tools 131/141 may include a tool attachment mechanism 139/149 which may be a hook configured to be inserted to a main rotary body 135/145.

Figure 6:
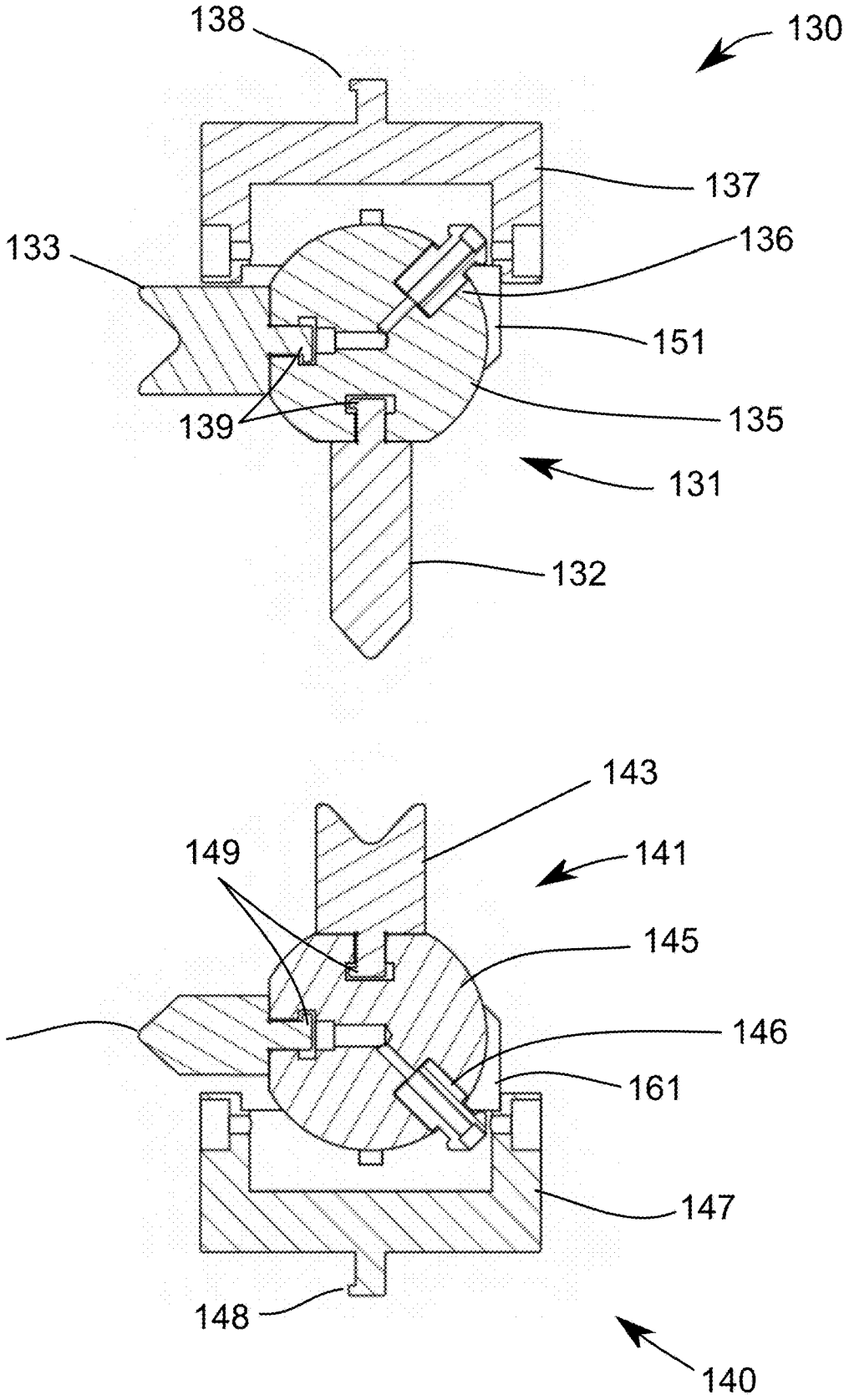
FIG. 6 is a cross-sectional view of the rotary tool assembly of FIG. 2 in the first position.
Figure 7:
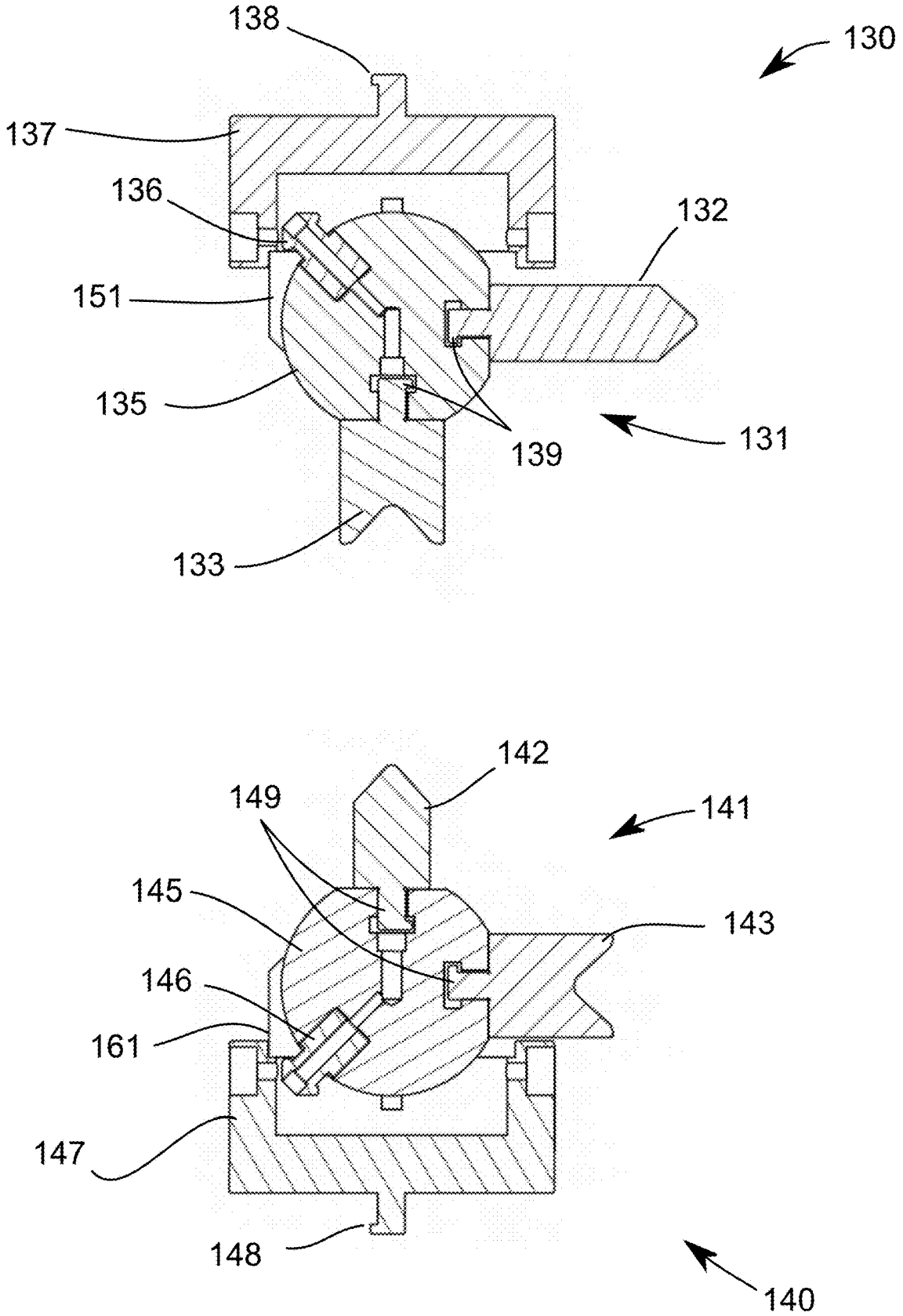
FIG. 7 is a cross-sectional view of the rotary tool assembly of FIG. 2 in the second position.

FIGS. 6 and 7 show a sectional view of the rotary tools in the first and second position respectively. Each rotary tools 131/141 further includes the main rotary body 135/145 that houses a portion of the position locking pins 136/146. The position locking pins are configured to abut a surface of the tool support 137/147 to prevent further rotation of the punch or die. The position locking pins only permit the punch or die of each rotary tool to be rotated approximately 90° so that only the first position or the second position can be set. This also means that the punch and die are angled approximately 90° apart. The position selection of the rotary tool can be automated or manually selected by a press brake operator via controller 400.

Figure 8:
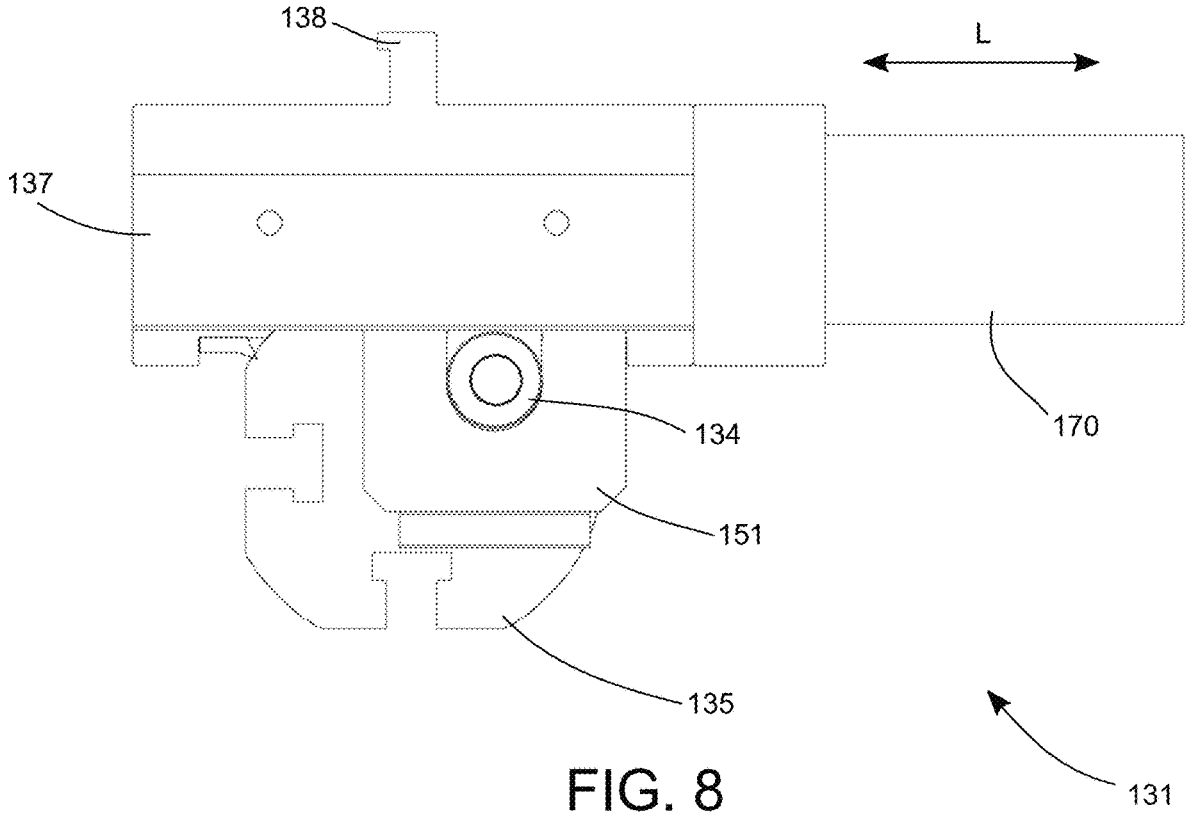
FIG. 8 is a close up of an exemplary upper tool assembly.

FIG. 8 shows a close up of the upper rotary tool assembly 130 with the linear actuator 170. The linear actuator moves in a lateral direction "L" which pushes and pulls the rotational bracket 151. The translation of the rotational bracket 151, in the lateral direction "L", pushes the rotational pin 134. The rotation pin 134 then rotates the main rotary body 135 via cam action, via the translational movement in the lateral direction "L", between the first position and the second position. Although only the upper rotary tool 130 is shown the same mechanism is utilized in lower rotary tool assembly 140 with the corresponding elements for the lower rotary tool assembly. Other mechanisms that utilize a linear to rotary motion may be utilized by the upper or lower tool assembly. The main body rotation may also be provided directly by motors providing direct rotary motion.

In sum, an improved press brake system is provided for efficient workpiece bending.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by to present disclosure.

It is important to note that the rotary tool assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A tool assembly configured to attach to an upper or lower beam of a press brake assembly configured to bend a workpiece, the tool assembly comprising:

a tool support configured to attach to one of the upper beam and lower beam;

the tool support configured hold a rotary tool, wherein the rotary tool comprises:

a main rotary body configured to hold a punch and a die configured to bend the workpiece;

wherein said main rotary body is configured rotate between a first position and a second position, a locking pin housed within the main rotary body, said locking pin rotates with the main rotary body between the first position and second position and configured to abut the tool support at a first locking pin side when the main rotary body is at the first position to prevent the main rotary body from rotating and also when the main rotary body is at the second position at a second locking pin side to prevent the main rotary body from rotating.

2. The tool assembly of claim 1, wherein the first position and second position is a rotation angled 90° apart.

3. The tool assembly of claim 1, wherein rotary tool can only be set at first position and second position.

4. The tool assembly of claim 1, further comprising a rotational bracket assembly configured to rotate the rotary tool between the first position and second position.

5. The tool assembly of claim 4, wherein the rotation bracket assembly includes an actuator configured to move the rotational bracket such that the rotational bracket rotates the rotary tool between the first position and second position.

6. The tool assembly of claim 4, wherein the actuator moves the rotation bracket assembly in a straight linear motion.

7. A tool assembly set for a press brake system configured to bend a workpiece, the tool assembly set comprising:

an upper tool support configured to attach to an upper beam;

a lower tool support configured to attach to a lower beam;

each of the upper and lower tool support configured hold a rotary tool, wherein the rotary tool comprises:

a main rotary body configured to hold tool attachments, said tool attachments including a punch and a die configured to bend the workpiece;

wherein said main rotary body is configured rotate between a first position and a second position by setting the punch or the die to bend the workpiece, a locking pin housed within the main rotary body, said locking pin rotates with the main rotary body between the first position and second position while being within said tool support during motion between the first position to the second position and configured to abut the tool support when the main rotary body is at the first position to prevent the main rotary body from rotating and also when the main rotary body is at the second position to prevent the main rotary body from rotating.

8. The tool assembly set of claim 7, wherein the rotary tool of the upper tool support is configured to set a different tool attachment than the rotary tool of the lower tool support when the press brake bends the workpiece.

9. The tool assembly of claim 1, wherein one end of the locking pin extends into a cavity of the tool support.

10. The tool assembly of claim 1, wherein the locking pin is configured to abut the support tool at a first side of the locking pin when the main rotary body is at the first position to prevent the main rotary body from rotating and at a second side of the locking pin when the main rotary body is at the second position.

11. The tool assembly of claim 7, wherein one end of the locking pin extends into a cavity of the tool support.

12. The tool assembly of claim 7, wherein the locking pin is configured to abut the support tool at a first side of the locking pin when the main rotary body is at the first position to prevent the main rotary body from rotating and at a second side of the locking pin when the main rotary body is at the second position.

13. A tool assembly configured to attach to an upper or lower beam of a machine configured to bend a workpiece, the tool assembly comprising:

a tool support configured to attach to one of the upper beam and lower beam;

the tool support configured hold a rotary tool, wherein the rotary tool comprises:

a main rotary body configured to hold a punch and a die configured to bend the workpiece;

wherein said main rotary body is configured rotate between a first position and a second position, a locking pin, where the locking pin is rotationally locked with the main rotary body and is configured to prevent the main rotary body from rotating when the main rotary body is at the first position or the second position wherein a rotation axis of the main rotary body extends in a different direction than of the length of the locking pin.

14. The tool assembly of claim 13, wherein the first position and second position is a rotation angled 90° apart.

15. The tool assembly of claim 13, wherein rotary tool can only be set at first position and second position.

16. The tool assembly of claim 13, further comprising a rotational bracket assembly configured to rotate the rotary tool between the first position and second position.

17. The tool assembly of claim 16, wherein the rotation bracket assembly includes an actuator configured to move the rotational bracket such that the rotational bracket rotates the rotary tool between the first position and second position.

18. The tool assembly of claim 16, wherein the actuator moves the rotation bracket assembly in a straight linear motion.

* * * * *